United States Patent [19]

Elkins

[11] Patent Number: 4,776,471

[45] Date of Patent: Oct. 11, 1988

[54] GUN RACK

[76] Inventor: Johnny C. Elkins, Rte. 5, Box 5124C, San Angelo, Tex. 76904

[21] Appl. No.: 9,689

[22] Filed: Feb. 2, 1987

Related U.S. Application Data

[63] Continuation-in-part of Ser. No. 691,403, Jan. 14, 1985, Pat. No. 4,648,516.

[51] Int. Cl.[4] ..... A47F 7/00

[52] U.S. Cl. ..... 211/64; 248/354.6; 224/42.45 R

[58] Field of Search ..... 211/64, 94, 94.5, 87, 211/103, 208; 224/42.45 R, 913; 248/354.5, 354.6

[56] References Cited

U.S. PATENT DOCUMENTS

| | | | |
|---|---|---|---|
| 621,856 | 4/1899 | Schwarz . | |
| 2,536,293 | 1/1951 | Koses | 211/87 |
| 3,731,817 | 5/1973 | Fowlkes et al. | 211/945 |
| 3,836,174 | 9/1974 | Holman, Jr. | 248/354.5 |
| 4,021,013 | 5/1977 | Miller | 248/354.6 |
| 4,108,313 | 8/1978 | Bogar, Jr. | 211/64 |
| 4,450,989 | 5/1984 | Bogar, Jr. | 211/64 X |
| 4,648,516 | 3/1987 | Elkins | 211/64 |

*Primary Examiner*—Ramon O. Ramirez
*Assistant Examiner*—Blair M. Johnson
*Attorney, Agent, or Firm*—Marcus L. Bates

[57] ABSTRACT

A gun mount comprises two spaced adjustable gun racks, each gun rack has a square tubular main body to which there is adjustably attached one or a plurality of upwardly opening cradles within which a gun can be supported. Each main body includes opposed attachement means by which it is removably supported from the rear window of a vehicle. One of the attachment means has a marginal end telescopingly received within the main body, and a blade is formed at the other end thereof. The other end of the main body is provided with an opposed blade. Each of the blades are received between the glass and the gasket of a vehicle window. The blades can be turned laterally so that a pair of the racks can be incorporated into a low profile package. The gun rack can be used in conjunction with a vehicle window, or alternatively, can be mounted directly to any wall surface.

16 Claims, 3 Drawing Sheets

FIG. 1
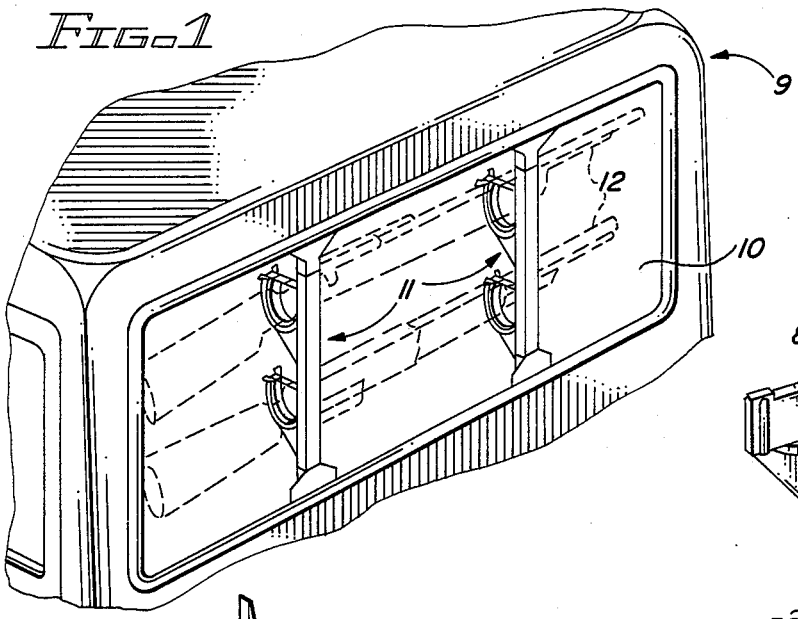
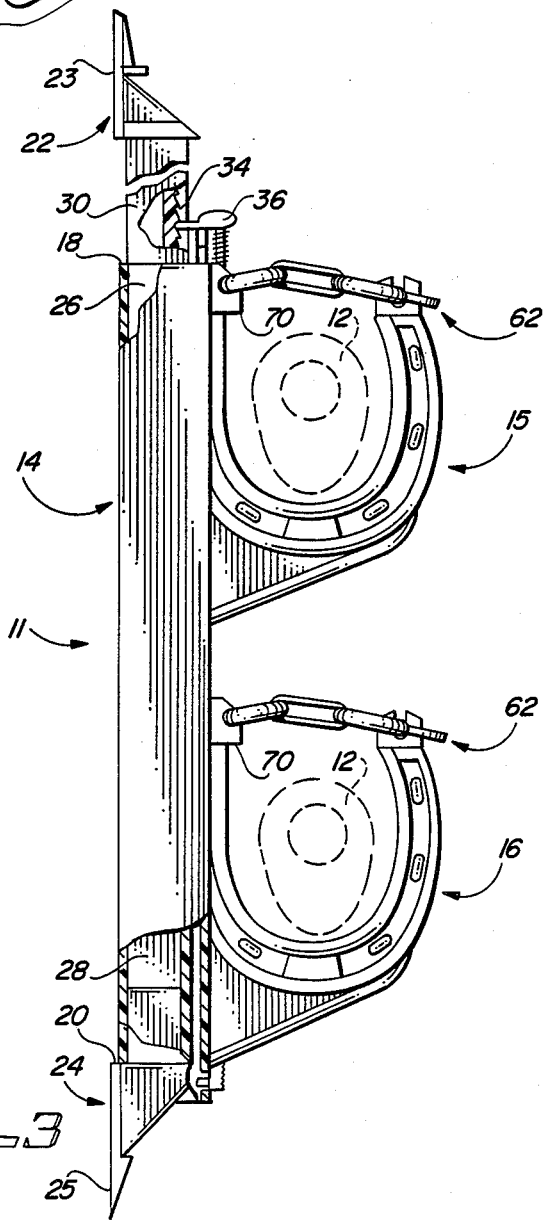
FIG. 3
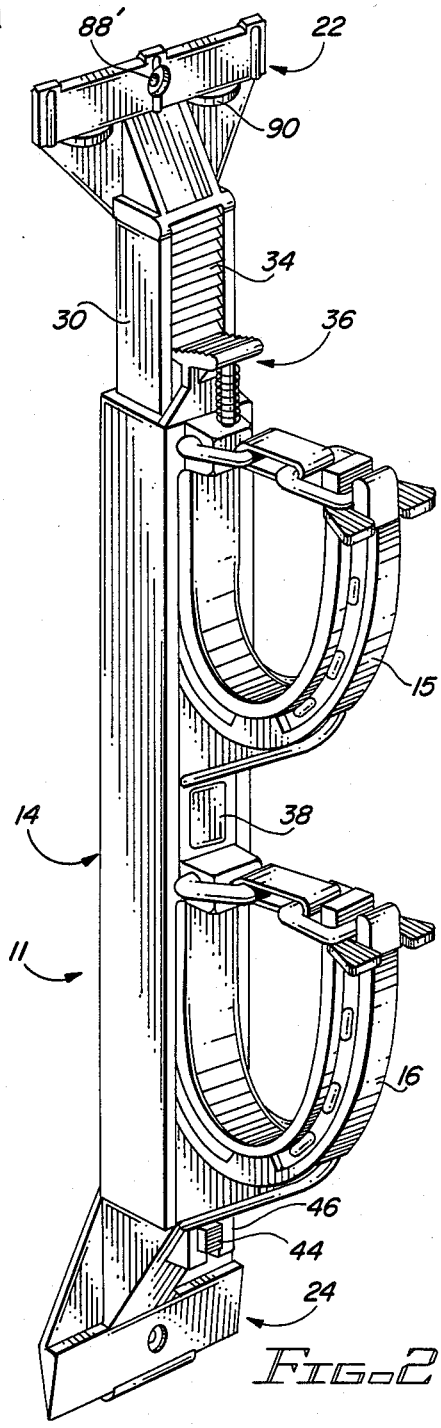
FIG. 2

GUN RACK

REFERENCE TO RELATED PATENT APPLICATIONS

This patent application is a continuation-in-part of U.S. patent application Ser. No. 691,403 filed Jan. 14, 1985, now U.S. Pat. No. 4,648,516 issued Mar. 10, 1987.

BACKGROUND OF THE INVENTION

In my previous U.S. Pat. Nos. 3,876,079; 3,931,893; 4,058,211; and U.S. Pat. No. Des. 238,228, there is disclosed a gun mount for attachment to the rear window of a vehicle. The gun mount includes spaced rack members, each of which is made into two coacting pieces so that the opposed attachment blades thereof can be extended respective to one another to thereby provide for a range of adjustment therebetween.

In my U.S. patent application Serial No. 691,403 filed Jan. 14, 1985, now U.S. Pat. No. 4,648,516, there is disclosed a gun rack which can be mounted on the rear window of a vehicle, such as a pickup truck, for example, as well as being used as a decorative rack mounted directly to any wall surface; for example, the wall surface of a home or hunting lodge. The gun rack has a main body which is supported at each end thereof by attachment means, wherein the attachment means can be moved respective to one another to provide a relatively great range of adjustment therebetween. The gun rack can accommodate any number of gun supporting cradles in the event that space considerations admit the length between the attachment means to be extended sufficiently to accommodate the extra cradles. The cradles can be adjustably movec along the length of the main body.

SUMMARY OF THE INVENTION

This invention is to a gun rack comprised of a square tubular main body having upper and lower attachment means formed at opposed ends thereof. The lower attachment means is removably affixed to the main body. The main body can be made any convenient length. The main body can adjustably receive any number of upwardly opening gun receiving cradles respective thereto.

The upper attachment means of the gun rack has a lower marginal end adjustably received in a slidable manner within the tubular main body. The upper end of the upper attachment means and the lower end of the lower attachment means terminate in a flat blade. The flat blade can be inserted in captured relationship between a window glass and a gasket therefor as found on the rear window of a pickup truck, for example. Alternatively, the blades of each of the opposed attachment means can be directly attached to any suitable wall surface.

Each of the cradles of the gun rack is captured to the main body in a slidable manner, and further include a latch means on one of the cradles by which the upper attachment means can be latched into a number of different predetermined positions, thereby making the overall length of the gun rack adjustable.

The lower attachment means preferably is removably affixed respective to the main body. The main body can be easily shortened to provide a large adjustment in length, and the telescoping action of the upper attachment means respective to the main body provides another adjustment means by which the spaced distance between the blades of the opposed attachment means can be adjusted.

The design of the cradle and its cooperative action with the main body provides an unusually rugged gun rack construction. Two racks, arranged in side by side spaced parallel relationship, provide an improved mount means by which firearms can be safely transported in a vehicle, or alternatively, provides a decorative gun mount when attached to most any wall surface.

Accordingly, a primary object of the present invention is the provision of an improved mount for supporting one or a plurality of firearms. The mount includes spaced improved racks having opposed attachment means, one of which is adjustably received respective to a main body thereof.

A further object of the present invention is the provision of an improved mount comprising a pair of spaced similar racks each rack having one or a plurality of gun receiving cradles which are slidably received respective to the main body of the rack, and opposed attachment means arranged so that the spaced distance between the upper attachment means and adjacent cradle of a rack can be easily vertically adjusted.

A still further object of this invention is the provision of a gun mount comprising a pair of racks, wherein each rack has opposed gun supports formed thereon which cooperate with a main body thereof in such a manner that the supports can be adjustably moved towards and away from one another, and means for capturing a gun within the gun supports.

Another and still further object of this invention is the provision of a gun mount comprising a pair of racks, each rack has a gun receiving cradle, each rack has a support telescopingly received in a slidable manner respective to a main body thereof by which the length of the rack can be changed to any desired length within a range of lengths.

These and various other objects and advantages of the invention are attained by the provision of a combination of elements which are fabricated in a manner substantially as described in the abstract and summary.

BRIEF DESCRIPTION OF THE DRAWINGS

FIG. 1 is a broken, perspective view of a part of the cab of a pickup truck with apparatus made in accordance with the present invention operatively associated therewith;

FIG. 2 is an enlarged, perspective view of the present invention;

FIG. 3 is a side view of the apparatus disclosed in FIG. 2, with some parts being removed therefrom and some of the remaining parts being shown in cross-section;

DETAILED DESCRIPTION OF THE PREFERRED EMBODIMENT

Figure 4:
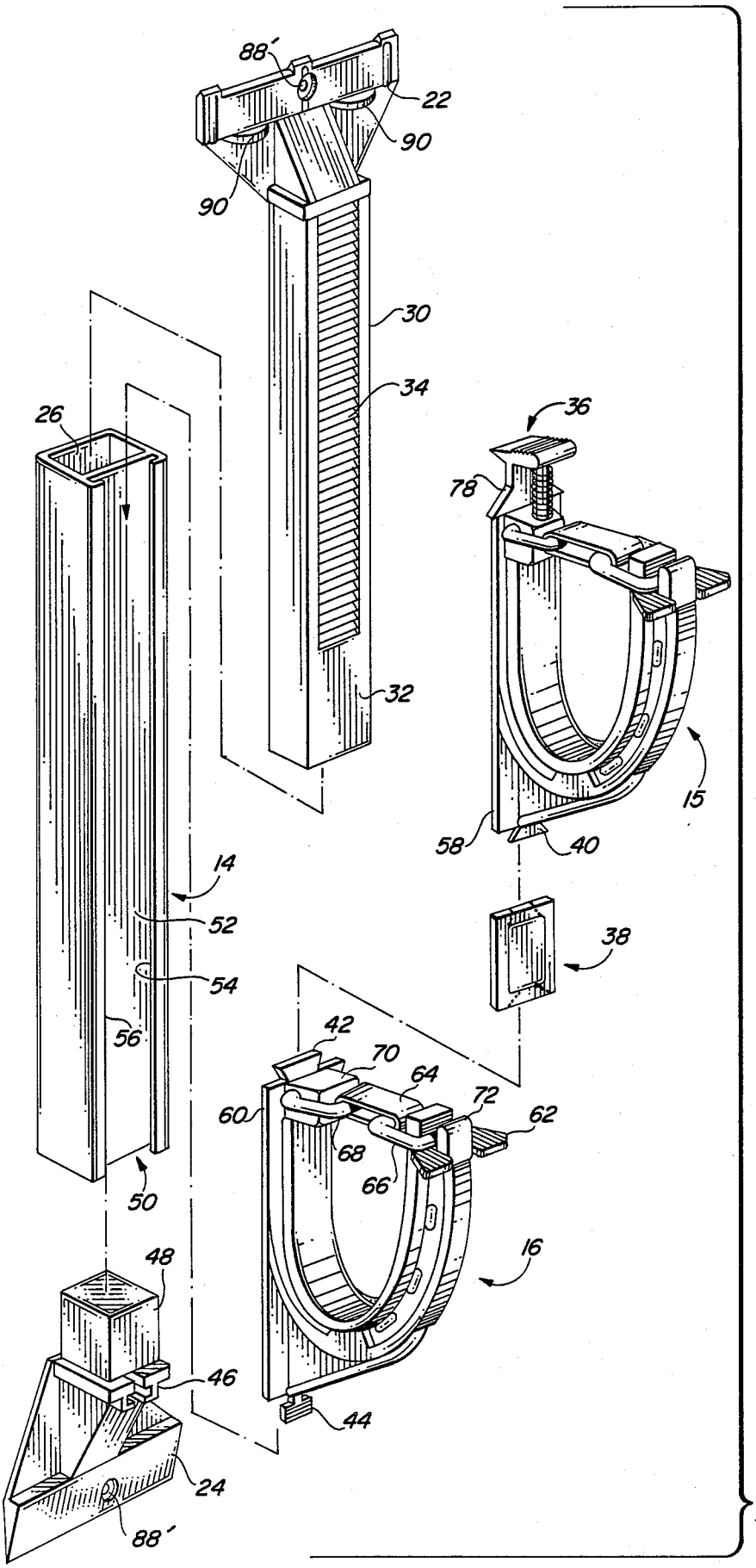
FIG. 4 is an exploded, perspective view of the apparatus disclosed in FIG. 2.
Figure 5:
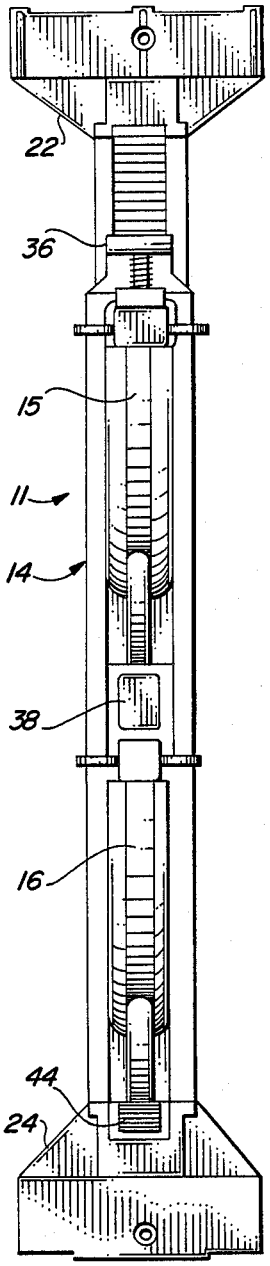
FIG. 5 is a front, elevational view of the apparatus disclosed in FIG. 2.

In FIG. 1 of the drawings, there is disclosed a pickup truck 9 having a rear window glass 10 held within the illustrated gasket which holds the glass respective to the opening that forms the window, in the usual manner. The pair of gun racks 11, made in accordance with the present invention, is attached to the window glass and gasket. Guns 12 are supported by the pair of gun racks 11 in a new and novel manner as will be more fully appreciated later on as the remainder of this disclosure is more fully digested.

As seen illustrated in FIGS. 2–5, each gun rack 11 includes a main body 14 having an upper cradle 15 and a lower cradle 16. The main body 14 has opposed ends 18, 20 with there being attachment means 22, 24 which define the upper and lower terminal ends of the rack 11. The main body 14 has a hollow interior 26, 28 at the upper and lower ends thereof. Preferably there is a passageway extending axially through the entire main body 14.

The attachment means 22 has an extension 30 integrally affixed thereto and extending into the upper end 26 of the before mentioned passageway. The extension has an outer wall surface 32, with the upper marginal length of the wall surface 32 being provided with the illustrated teeth 34. The teeth 34 are arranged parallel to one another and in a horizontal plane.

A ratchet means 36 is an integral part of the upper cradle 15. The ratchet means 36 selectively engages any one of the teeth 34 and thereby restrains downward relative motion between the attachment means 22 and cradle 15. It will be noted that the teeth 34 are arranged respective to the ratchet means 36 whereby the attachment means 22 can be forced into an extended position; however, the attachment means can not be retracted unless the ratchet means 36 is released from the teeth 34.

An interlock tab 38 is slidably captured respective to the main body 14, and is connected between the cradles 15 and 16. As best seen in FIG. 4, the lower extremity of cradle 15 includes a dovetail attachment means 40 which is received within a complementary configured recess of the interlock tab 38. The upper end of cradle 16 includes a similar dovetail projection 42 which is received within a complementary configured recess formed in the lower end of the interlock tab 38. Accordingly, the interlock tab 38 removably attaches the cradle means 15 and 16 one to the other.

The lower extremity of the lower cradle 16 has a T-shaped tab 44 extending therefrom. The lower attachment means 24 has a receptacle 46 formed thereon for receiving the T-shaped tab 44 therein, thereby releasably locking the lower cradle 16 to the lower attachment means 24. The lower attachment means 24 terminates in an upwardly extending square socket 48 which is of a configuration to be received within the before mentioned hollow interior 28 formed at the lower end of the main body 14.

Accordingly, the apparatus indicated by the numerals 38, 40, 42, 44, and 46 jointly cooperate together to provide means by which the cradle 15 is fixed respective to cradle 16 and to the attachment means 24. Hence, the two cradles 15 and 16 are connected together, and the lower cradle 16 is attached to the lower attachment means 24. Hence, the entire assembly 15, 38, 16, and 24 can not be slidably removed downwardly from the main body 14.

The main body 14 has a longitudinally extending slot 50 formed outwardly of wall 52. The outer wall 52, together with the opposed inturned confronting spaced walls 54 and 56, form the slot 50. A tongue 58 forms a rear surface of cradle 15, while a tongue 60 forms a rear surface of cradle 16°. Each tongue, 58 and 60, is received in a slidable manner in captured relationship within the slot 50 of the main body. The interlock tab 38 is similarly received within the slot 50.

Figure 6:
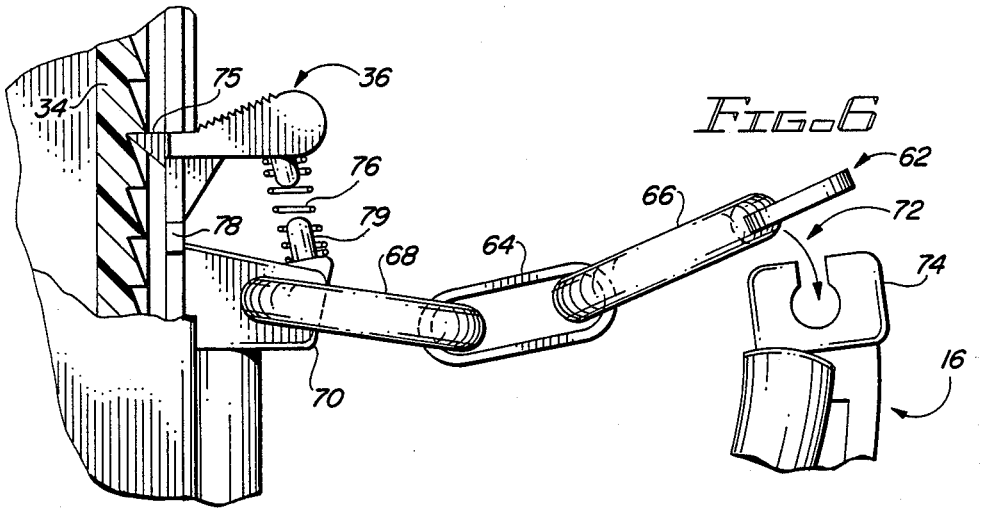
FIG. 6 is an enlarged, fragmentary, part cross-sectional view of part of the apparatus disclosed in FIG. 2.
Figure 7:
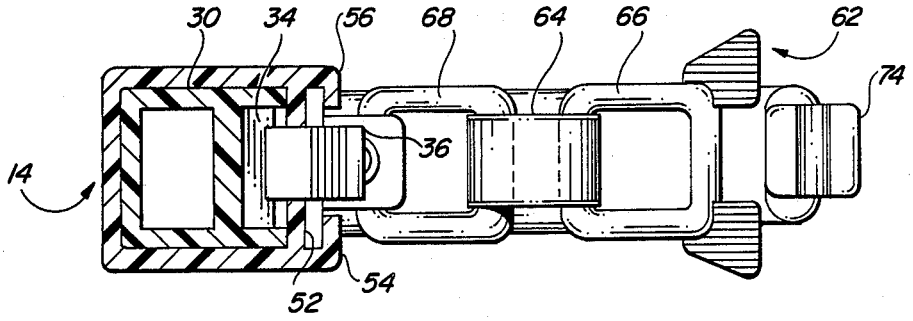
FIG. 7 is a top, part cross-sectional view of the apparatus disclosed in FIG. 6; and, FIG. 8 illustrates the apparatus of the present invention packaged for shipment.

Each cradle 15 and 16 is provided with an upper gun restraining member 62. As best seen illustrated in FIGS. 6 and 7, the gun restraining member 62 includes an elastomeric member 64 in the form of an endless belt which is connected to links 66 and 68. The link 68 is attached to enlargement 70 located adjacent to tongue 60 (see FIG. 4); while one end of the link 66 is received within a slot 72 located at the upper end of the enlarged portion or boss 74 that forms the upper terminal end of the outer part of the cradles 15 and 16. The link 66 must be turned towards the vertical in order to be released from the boss 74.

The ratchet means 36 includes a spring 76 which is captured between members 36 and 70 by the illustrated shaft-like members 79. The shaft-like members 79 are received within the spring 76 and position the spring whereby the member 36 is biased away from member 70, while the wedge-like member 75 engages the teeth 34. A resilient extension 78 augments the action of spring 76 and resists being bent away from the plane of the tongue 58. Extension 78 is a continuation of tongue 58.

Figure 8:
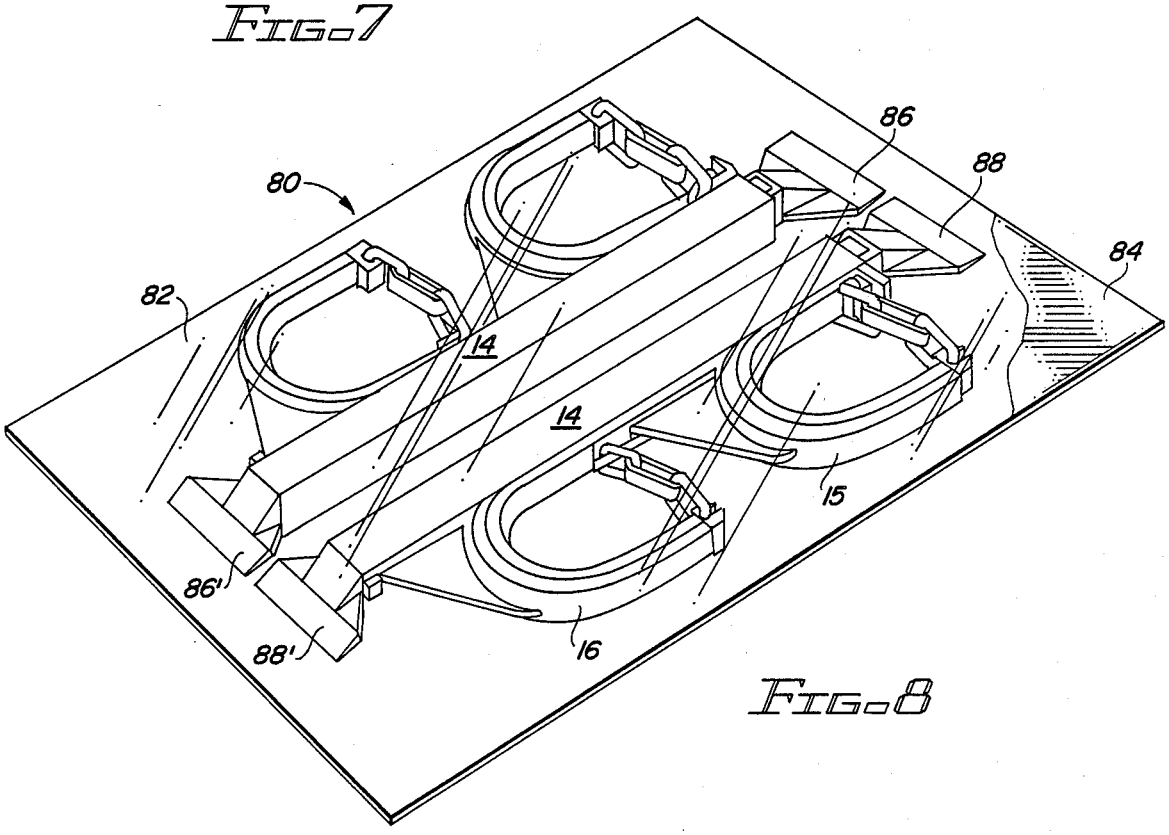

FIG. 8 sets forth a unique manner in which a gun rack, built in accordance with the present invention, can be packaged. The novel packaged goods disclosed in FIG. 8 is considered to be a subcombination of the present invention. As seen illustrated in FIG. 8, the packaged goods 80 comprises a self-supporting planer surface 82, as for example heavy cardboard which forms a self-supporting surface for two of the racks 11. The cardboard 82 and racks 11 are covered with thin plastic film 84, preferably a plastic transparent film that has been shrunk in a manner to tightly encapsulate both the upper surface of the cardboard 82 and the two gun racks 11.

The carboard 82 can be slit at 86, 86′ and 88, 88′ so that the marginal terminal end of the blade members can be received through the slits and thereby hold the racks in place. The restraining means 62 preferably are fastened in the closed position.

Another unique feature of the packaged goods 80 is provided by the orientation of the attachment means 22, 24. The upper and lower attachment means 22, 24 have been rotated 90° respective to the main body 14 of the racks 11 so that the blade members of the attachment means lie flat against the upper surface of the cardboard 82, thereby providing a low profile package and accordingly, a large number of packaged goods 80 can be attractively packaged and accommodated within a much smaller volume than would otherwise be possible with a gun rack not having attachment means 22, 24 which can be oriented from the illustrated position seen in FIG. 2 into the illustrated position seen in FIG. 8, for example.

The blades of the attachment means are provided with holes or apertures 88′ by which the racks can be attached to surfaces other than the pickup window 10. Numeral 90, located on the upper attachment means, accommodates the thumb of ones left and right hand so that the extension 30 can easily be telescoped away from the main body 14.

In operation, a rack 14 is assembled by sliding tongue 60 of lower cradle 16 into the slot 50 of the main body 14. The interlock tab 38 is connected to the dovetail projection 42 of the lower cradle 16 and the assembly 16, 15 moved downwardly within the slot a limited distance which admits the dovetail projection 40 of the upper cradle 15 being received by the interlock tab 42. The entire assembly is then moved along slot 50 into the illustrated position seen in FIGS. 2, 3, 5, and 8 of the drawings.

Next the upper and lower attachment means 22 and 24 are assembled to the main body by telescoping the extension 30 and socket 48, respectively, into the marginal ends 26 and 28, respectively, of the main body.

At this time, the orientation of the attachment means respective to the main body is determined by the election to provide a rack as seen in FIG. 2, or packaged goods as seen in FIG. 8.

The apparatus of the present invention preferably is marketed and received by a consumer as the packaged goods 80 disclosed in FIG. 8. The plastic film 84 is removed from the self supporting base 82, and then the attachment means 22, 24 are removed from the main body 14 and rotated 90° into the position of FIG. 2. The lower blade 25 of the lower attachment means 24 can then be inserted between the gasket and glass of a vehicle rear window. Next, the right and left thumbs of a person's hands are placed against the impressions 90 of the upper blade member 23 of the upper attachment means 22, and a force is exerted at 90 thereby causing the extension 30 to be extended in a telescopic manner from the hollow main body 14 until the marginal terminal end of the blade 23 is received between the gasket and the glass of the pickup window 10 (FIG. 1).

During the extension of the member 30 from the main body 14, the ratchet means 36 will permit the teeth 34 to ratchet, or move upwardly respective thereto, until the upper and lower attachment means 22, 24 are properly received in sandwiched relationship between the window glass and gasket. The teeth 34 of extension 30 being engaged by the ratchet means 36, will not permit the extension 30 to be retracted within the main body 14 until the wedge-like member 75 is forced away from the teeth 34. The sharp terminal ends of the blades engage the gasket interior and hold the rack in mounted position.

Next, the restraining member 62 is unlatched from slot 72 so that the upwardly opening cradles 15 and 16 can receive a gun 12 therewithin. This is easily accomplished by merely grasping the diverging wings of the member 62 between the fingers, rotating the wings in a counterclockwise direction as viewed in FIGS. 2 and 3, whereupon the member 66 will ride out of the slot 72 of the upwardly opening receptacle 74 so that the entire restraining member 62, 66, 64, 68 can be lifted in a pivotal manner in order to remove any obstacle from the upwardly opening cradle. The member 62 is replaced in the reversed manner. The elastomeric member 64 can be stretched to accommodate large firearms, and the member 62 prevents a firearm from inadvertently being bumped, jarred, or otherwise removed from the cradle means. Moreover, the restraining means 62 provides a latch which children find difficult to open, and this feature of the invention imparts safety into the gun rack, vehicle, and gun combination.

I claim:

1. A gun rack for mounting guns in supported relationship therewithin; said rack includes a main body having means forming at least two gun receiving cradles; said main body includes opposed ends; attached means formed at each opposed end of said main body by which said rack can be affixed to a support surface;

said main body has a hollow interior at one end thereof, means forming an extension on one said attachment means; said extension is slidably received within the hollow interior of said main body, thereby enabling the spaced opposed attachment means to be moved towards and away from one another, and thereby adjust the distance therebetween;

said extension has one outer wall surface which is provided with teeth, means formed on one said cradle which engages the teeth of the outer wall surface and thereby adjustably secures the extension to the cradle;

means releasably connecting the other said cradle directly to the other of said attachment means to thereby prevent movement therebetween.

2. The gun rack of claim 1 wherein one said cradle includes restraining means by which a gun may be releasably fastened within one said cradle.

3. The gun rack of claim 1 wherein said main body has a longitudinally extending slot formed thereon within which said cradles are slidably received; means by which said two cradles are releasably connected together, and apparatus by which one cradle is releasably connected to said other attachment means.

4. The gun rack of claim 3 wherein said cradles are upwardly opening and include restraining means by which a gun may be releasably fastened within each said cradle;

said restraining means include a plurality of links connected together in a manner to close the opening of the cradle.

5. The gun rack of claim 1 wherein said attachment means are in the form of blade members which can be oriented 90° from the usual operative position respective to the main body and thereby provide a low profile package of gun racks.

6. A gun rack by which a gun can be mounted in supported relationship therewithin; said rack includes a main body having opposed ends; means forming two gun receiving cradles; attachment means formed at each opposed end of said main body by which said rack can be affixed to a support surface, such as a wall surface;

said main body has a hollow interior at one end thereof; one said attachment means has an extension which is slidably received within the hollow interior of the main body, thereby enabling the opposed attachment means to be moved towards and away from one another, and thereby adjust the distance therebetween; said extension has spaced teeth formed thereon;

said main body is an elongated square tubular member having opposed sidewalls extending beyond a common sidewall and turned inwardly towards one another to form an outwardly opening slot;

each said cradle has a tongue affixed thereto, the tongue of each said cradle is made into a configuration to be slidably received within said slot, said cradles include a gun receiving part which is of U-shaped configuration and upwardly opens;

means releasably capturing said cradles respective to said slot so that each cradle can be held stationary respective to said slot; a ratchet on one said cradle for releasably engaging the teeth on the extension; means releasably connecting the other said cradle to the other of the attachment means; whereby: said attachment means can be extended away from one another while said ratchet engages said teeth and prevents the attachment means from moving towards one another.

7. The gun rack of claim 6 wherein said cradles each includes restraining means by which a gun may be releasably fastened within said cradles.

8. The gun rack of claim 6 wherein said attachment means are in the form of blade members which can be oriented 90° from the usual operative position respective to the main body and thereby provide a low profile package of gun racks.

9. Apparatus for mounting guns comprising spaced gun racks, each rack includes an elongated hollow main body having opposed ends and a plurality of upwardly opening cradles attached thereto; attachment means positioned at each opposed end of said main body; an elongated slot formed along said main body;

one said attachment means includes an extension which is slidably received in a telescoping manner within said main body; means for adjustably affixing said extension respective to said main body;

said extension has one outer wall surface which is provided with a plurality of teeth, ratchet means for engaging the teeth of the outer wall surface with a ratchet action and thereby adjustably secures the extension to the main body;

each of said cradles include a slide member attached thereto which is slidably received within said elongated slot; and means by which said cradles are affixed to one another and to one of said attachment means.

10. The apparatus of claim 9 wherein said cradles include restraining means by which a gun may be releasably fastened within either of said cradles.

11. The apparatus of claim 9 wherein said main body has opposed sidewalls extended beyond a common sidewall to form said slot therein; said slide member of each said cradle has a front and a rear side, a tongue is formed on said rear side and is slidably received within said slot, abutment means on one said slide member which abuts one end of said main body and limits downward movement of one said cradle respective to said main body.

12. The apparatus of claim 9 wherein said ratchet means is formed on one of said cradles and extends upwardly therefrom into engagement with said teeth.

13. The gun rack of claim 1 wherein said main body has a slot formed therein; each said cradle has a slide member which is slidably received within said slot, abutment means on one said slide member which abuts one end of said main body and limits downward movement of one of said cradles respective to said main body.

14. The gun rack of claim 3 wherein said main body has a longitudinally extending slot formed therein; each said cradle includes a slide member integrally attached thereto which is slidably received within said slot, abutment means on said slide member which abuts one end of said main body and thereby limits downward movement of one of said cradles respective to said main body.

15. The gun rack of claim 6 wherein said slot extends the entire length of said main body; the tongue of each said cradle is free to slide along the entire length of said slot, abutment means on one said slide member which abuts one end of said main body and limits downward movement of said cradle means respective to said main body.

16. The gun rack of claim 6 wherein said ratchet means is formed on one said cradle and extends upwardly therefrom into engagement with said teeth.

* * * * *

UNITED STATES PATENT AND TRADEMARK OFFICE

CERTIFICATE OF CORRECTION

PATENT NO. : 4,776,471

DATED : OCTOBER 11, 1988

INVENTOR(S) : JOHNNY C. ELKINS

It is certified that error appears in the above-identified patent and that said Letters Patent is hereby corrected as shown below:

Column 1, line 34, correct the spelling of "moved";

Column 4, line 6, substitute --16-- for "16°"

Column 6, line 4, substitute --attachment-- for "attached".

Signed and Sealed this

Twenty-eighth Day of March, 1989

*Attest:*

DONALD J. QUIGG

*Attesting Officer*

*Commissioner of Patents and Trademarks*